US009701383B1

(12) United States Patent
Stuber et al.

(10) Patent No.: US 9,701,383 B1
(45) Date of Patent: Jul. 11, 2017

(54) OUTBOARD MOTOR AND MARINE PROPULSION SUPPORT SYSTEM

(71) Applicant: Brunswick Corporation, Lake Forest, IL (US)

(72) Inventors: Robert W. Stuber, Rosendale, WI (US); Andrew Tuchscherer, Wauwatosa, WI (US); Wayne M. Jaszewski, Jackson, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 14/940,760

(22) Filed: Nov. 13, 2015

(51) Int. Cl.
*B63H 1/15* (2006.01)
*B63H 21/30* (2006.01)
*B63H 20/06* (2006.01)

(52) U.S. Cl.
CPC ..... *B63H 20/06* (2013.01)

(58) Field of Classification Search
CPC ..... B63H 20/02; B63H 20/06; B63H 20/08
USPC ..... 440/52, 55
See application file for complete search history.

(56) References Cited

U.S. PATENT DOCUMENTS 3,613,631 A 10/1971 Wick et al.
3,934,537 A * 1/1976 Hall ..... B63H 20/08 188/268
4,507,090 A * 3/1985 Kobayashi ..... B63H 20/08 248/640
5,180,319 A 1/1993 Shiomi et al.
5,194,025 A 3/1993 Blanchard et al.
5,219,306 A * 6/1993 Takahashi ..... F02B 61/045 248/640
6,419,534 B1 7/2002 Helsel et al.
6,830,492 B1 12/2004 Magee et al.
7,198,530 B1 4/2007 Rothe et al.
7,244,152 B1 7/2007 Uppgard
7,896,304 B1 3/2011 Eichinger et al.
8,690,618 B2 * 4/2014 Takase ..... B63H 20/10 440/53
8,795,010 B1 8/2014 Wiatrowski
(Continued)

OTHER PUBLICATIONS

Wayne M. Jaszewski, "Outboard Motor with Lightweight Midsection Housing", Unpublished U.S. Appl. No. 14/317,424, filed Jun. 27, 2014.

(Continued)

*Primary Examiner* — Anthony Wiest
(74) *Attorney, Agent, or Firm* — Andrus Intellectual Property Law, LLP

(57) ABSTRACT

A marine propulsion support system includes a transom bracket, a swivel bracket, and a mounting bracket. A drive unit is connected to the mounting bracket by a plurality of vibration isolation mounts, which are configured to absorb loads on the drive unit that do not exceed a mount design threshold. A bump stop located between the swivel bracket and the drive unit limits deflection of the drive unit caused by loads that exceed the threshold. An outboard motor includes a transom bracket, a swivel bracket, a cradle, and a drive unit supported between first and second opposite arms of the cradle. First and second vibration isolation mounts connect the first and second cradle arms to the drive unit, respectively. An upper motion-limiting bump stop is located remotely from the vibration isolation mounts and between the swivel bracket and the drive unit.

18 Claims, 5 Drawing Sheets

(56) References Cited

U.S. PATENT DOCUMENTS

| | | | |
|---|---|---|---|
| 8,820,701 | B1 | 9/2014 | Eichinger |
| 2009/0170384 | A1 | 7/2009 | Balogh et al. |
| 2013/0316603 | A1 | 11/2013 | Hagi |

OTHER PUBLICATIONS

Charles H. Eichinger, "Vibration Isolation Mounting Arrangement for Outboard Motor", Unpublished U.S. Appl. No. 14/593,519, filed Jan. 9, 2015.

Charles H. Eichinger, "Mounts, Mounting Arrangements, and Methods of Making Mounting Arrangements for Supporting Outboard Motors with Respect to Marine Vessels", Unpublished U.S. Appl. No. 14/330,369, filed Jul. 14, 2014.

* cited by examiner

OUTBOARD MOTOR AND MARINE PROPULSION SUPPORT SYSTEM

FIELD

The present disclosure relates to outboard motors and support systems for coupling marine propulsion systems to transoms of marine vessels.

BACKGROUND

The following patents and patent applications are incorporated herein by reference.

U.S. Pat. No. 7,244,152 discloses an adapter system that is provided as a transition structure which allows a relatively conventional outboard motor to be mounted to a pedestal which provides a generally stationary vertical steering axis. An intermediate member is connectable to a transom mount structure having a connector adapted for mounts with central axes generally perpendicular to a plane of symmetry of the marine vessel. Many types of outboard motors have mounts that are generally perpendicular to this configuration. The intermediate member provides a suitable transition structure which accommodates both of these configurations and allows the conventionally mounted outboard motor to be supported, steered, and tilted by a transom mount structure having the stationary vertical steering axis and pedestal-type configuration.

U.S. Pat. No. 7,896,304 discloses a support system for an outboard motor that uses mounts which are configured and positioned to result in an elastic center point being located closely to a roll axis of the outboard motor which is generally vertical and extends through a center of gravity of the outboard motor. The mounts are positioned so that lines which are perpendicular to their respective center lines intersect at an angle which can be generally equal to 90 degrees. The mounts are positioned in non-interfering relationship with the exhaust components of the outboard motor and its oil sump.

Unpublished U.S. patent application Ser. No. 14/317,424, filed Jun. 27, 2014, discloses an outboard motor to be coupled to a transom of a marine vessel, including a midsection housing having a front side configured to face the transom, a back side opposite the front side, a left side, and an opposite right side. An engine having an engine block is mounted directly to and supported by the midsection housing. A driveshaft is coupled in torque transmitting relation with a crankshaft of the engine, and a portion of the driveshaft is located exterior to the midsection housing. An exhaust pipe that conveys exhaust gas from an exhaust gas outlet of the engine downwardly away from the engine is also located exterior to the midsection housing. In one example, the midsection housing serves as a sump for engine oil.

Unpublished U.S. patent application Ser. No. 14/593,519, filed Jan. 9, 2015, discloses an arrangement for coupling a vibration isolation mount to an outboard motor. A pocket is formed in a midsection housing of the outboard motor and defines a first concave surface. A cover is configured to be mounted to the midsection housing over the pocket via a plurality of fasteners. The cover defines a second, oppositely concave surface on an inner face thereof. When the cover is mounted to the midsection housing over the pocket, the first concave surface and the second concave surface together form a cavity therebetween for holding a vibration isolation mount therein. One of the first concave surface and the second concave surface has a protrusion that extends into the cavity and contacts the mount held therein upon tightening of the plurality of fasteners to hold the cover over mount in the pocket. A mounting arrangement is also provided.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In one example of the present disclosure, a marine propulsion support system comprises a transom mounting system including a transom bracket configured to be mounted to a transom of a marine vessel. A swivel bracket is coupled to the transom bracket. A mounting bracket is coupled to the swivel bracket, and a drive unit is coupled to the mounting bracket. A plurality of vibration isolation mounts connects the drive unit to the mounting bracket. The plurality of vibration isolation mounts is configured to absorb loads on the drive unit that do not exceed a mount design threshold. A bump stop located between the swivel bracket and the drive unit limits deflection of the drive unit caused by loads that exceed the threshold.

In another example of the present disclosure, a marine propulsion support system comprises a transom mounting system configured to be mounted to a transom of a marine vessel; a drive unit coupled to the transom mounting system; and a plurality of vibration isolation mounts coupling the drive unit to the transom mounting system. The plurality of vibration isolation mounts are configured to absorb loads on the drive unit that do not exceed a mount design threshold. A bump stop is located between the drive unit and the transom mounting system. The bump stop limits deflection of the drive unit caused by loads that exceed the threshold. The bump stop is also located proximate a minimum fore-aft clearance between the transom mounting system and the drive unit, and prevents direct contact between the drive unit and the transom mounting system that would otherwise occur due to deflection of the drive unit caused by loads that exceed the threshold. The bump stop is also located remote from the plurality of vibration isolation mounts.

According to another example of the present disclosure, an outboard motor comprises a transom bracket configured to be mounted to a transom of a marine vessel, a swivel bracket pivotally coupled to the transom bracket about a horizontal tilt-trim axis, and a cradle coupled to the swivel bracket. The cradle has first and second opposite arms, and a drive unit is supported between the first and second opposite arms of the cradle. The outboard motor also includes first and second upper vibration isolation mounts, the first upper vibration isolation mount connecting the first cradle arm to the drive unit, and the second upper vibration isolation mount connecting the second cradle arm to the drive unit. An upper motion-limiting bump stop is located remotely from the first and second upper vibration isolation mounts and between the swivel bracket and the drive unit.

BRIEF DESCRIPTION OF THE DRAWINGS

The present disclosure is described with reference to the following Figures. The same numbers are used throughout the Figures to reference like features and like components.

DETAILED DESCRIPTION

Figure 1:
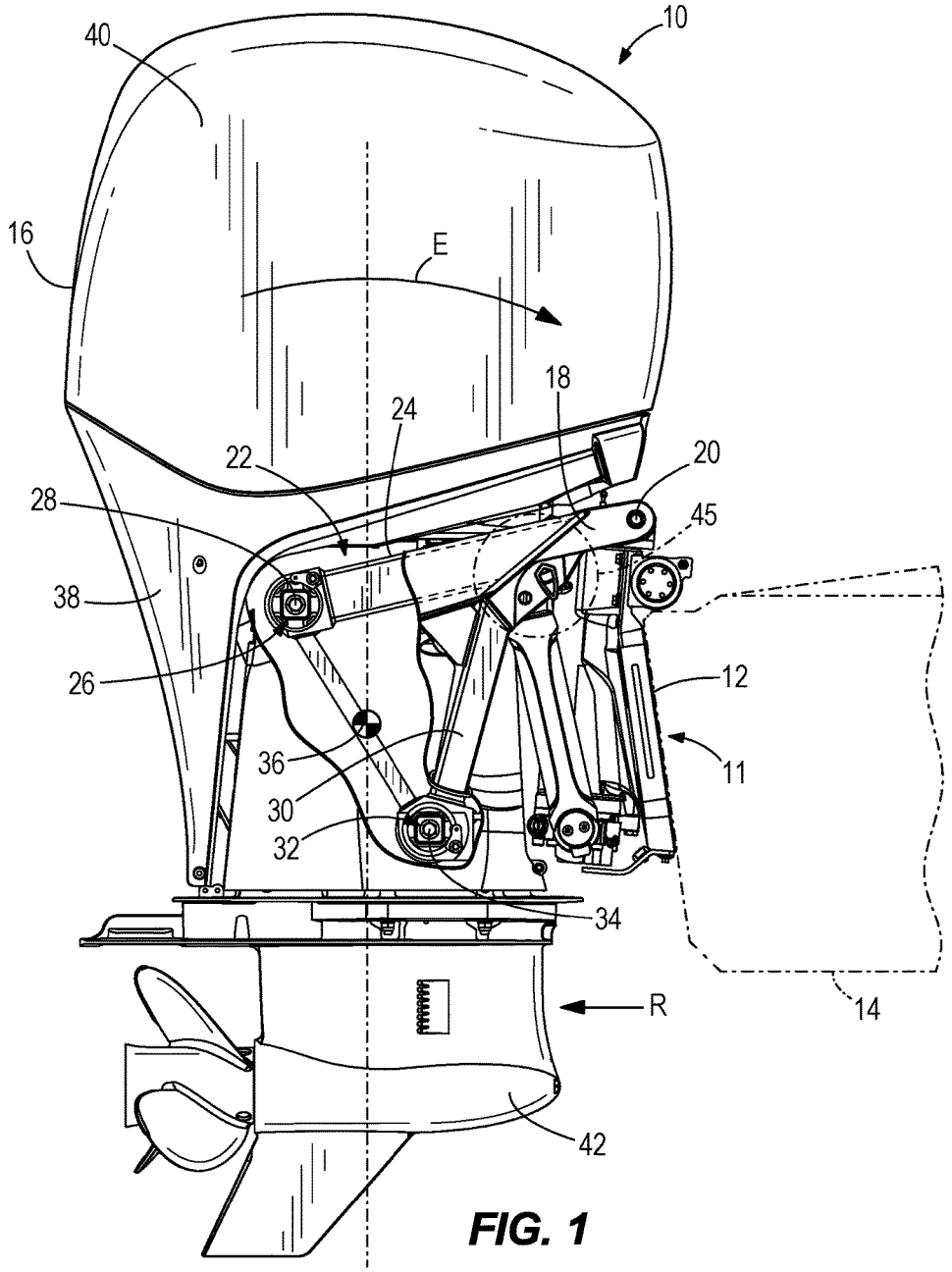
FIG. 1 illustrates a side view of an outboard motor according to the present disclosure.

In the present description, certain terms have been used for brevity, clarity and understanding. No unnecessary limitations are to be inferred therefrom beyond the requirement of the prior art because such terms are used for descriptive purposes only and are intended to be broadly construed.

Typically, marine propulsion units such as outboard motors are coupled to the transom of a marine vessel by way of one or several mounting structures located between the propulsion unit and the transom. One or more vibration isolation mounts are provided at points of connection between the transom mounting system and the drive unit in order to damp noise and vibration created by movement of the drive unit with respect to the mounting system and to prevent transfer of vibration from the drive unit to the marine vessel. Elastomeric vibration isolation mounts typically have multiple spring rates to provide the best noise, vibration, and harshness (NVH) isolation as possible, while attempting to limit motion under high static loads imposed on the outboard motor. However, existing systems typically require that NVH damping, drive unit handling, drive unit packaging, and vessel packaging be traded against one another, and therefore compromised, in order to provide a mount package that will fit within the constraints of the space between the outboard motor and the mounting system, as well as in order to provide the required fatigue life of the mount. Further, as outboard motors get larger (i.e., increase in horsepower), the loads imparted on the mounts increase, but the allowable deflections do not increase. At the same time, when multiple outboards are installed on one transom, this is not necessarily done on a larger boat, and thus the clearances and transom packaging remain the same or are smaller. As clearances between moving and stationary components tend to become smaller, in some cases, such as under high static loads, this may cause interference between neighboring outboards and between the outboards and the vessel transom. This results in further NVH compromises being made in order to limit such motion.

Static loads that may be encountered include those that result from the outboard motor striking a log or other hard object under the water or from high reverse thrust produced by the outboard motor. Through research and development, the present inventors found that these two types of static loads typically result in the largest amount of outboard motor motion. Rather than working within the packaging constraints of a small envelope between the outboard motor and the mounting system, the present inventors determined that in order to both provide NVH isolation and limit deflections under high static loads, the isolation-mounting system could be decoupled from the deflection-limiting system, and thereafter the two systems might be located remotely from one another. Thus, the presently described systems provide for optimized NVH, improved hydrodynamic handling, and tight transom packaging at the same time.

The examples described below show how by allowing contact between a bump stop located between the transom mounting system and the outboard drive unit the motion-limiting function can be decoupled from the vibration-isolation function performed by the mounts, thus allowing the systems providing the two functions to be tuned independently of one another. The present inventors also recognized that a particular advantage of the present disclosure is that it locates the motion-limiting system in an area close to where clearances between the transom mounting system and the outboard drive unit are least, and therefore need to be maintained. This location is generally at some distance from an elastic motion axis 36 (see FIG. 1) of the outboard motor, where the motion-limiting system can be direct acting and most effective. Attempting to limit motion at this large distance with a traditional mounting system using only elastomeric vibration isolation mounts is difficult due to the need for high durometer elastomer materials that worsen NVH, additional motion contributions from multiple outboard component tolerances, and deflection of the outboard structure due to high loads created when the outboard is used beyond its intended design.

FIG. 1 shows an outboard motor 10 including a transom mounting system 11. A drive unit 16 of the outboard motor 10 includes a powerhead 40, a driveshaft housing 38, and a lower unit 42, which will be described further herein below. The transom mounting system 11 includes a transom bracket 12 configured to be mounted to a transom 14 of a marine vessel. Between the transom bracket 12 and the drive unit 16 is a swivel bracket 18, which is pivotably coupled to the transom bracket 12 about a horizontal tilt/trim axis 20. A cradle (or, more generally, a mounting bracket) 22 is coupled to the swivel bracket 18 and has first and second opposite arms, of which one is shown here at 24. Another cradle arm 25, which is a mirror image of cradle arm 24, is provided on the opposite side of the outboard motor 10 as can be seen, for example, in FIGS. 3 and 6. Drive unit 16 is supported between the first and second opposite arms 24, 25 of the cradle 22. Such support is provided by way of first and second upper vibration isolation mounts, one of which is shown at 26. The second upper vibration isolation mount is located at a similar position at the distal end of cradle arm 25 on the opposite side of the outboard motor 10. In fact, it should be understood that any description of mounting components on the starboard side of the outboard motor 10 provided herein applies to components on the port side as well, but such description of the port side will not be provided for the sake of brevity. Thus, the first upper vibration isolation mount 26 connects the first cradle arm 24 to the drive unit 16, and the second upper vibration isolation mount connects the second cradle arm 25 to the drive unit 16.

Attachment of the upper mount 26 to the drive unit 16 and the cradle arm 24 can be made by way of a threaded fastener 28, as known to those having ordinary skill in the art. In the outboard motor 10 of the present disclosure, additional lower vibration isolation mounts are provided. First and second arm extensions, the starboard one of which is shown at 30, depend generally downwardly from the first and second cradle arms 24, 25 respectively. First and second lower vibration isolation mounts, one of which is shown at 32, connect the first arm extension 30 to the drive unit 16 and the second arm extension to the drive unit 16, respectively. Similar to the upper mount 26, the lower vibration isolation mount 32 is connected to both the cradle arm extension 30 and the drive unit 16 by way of a fastener 34.

As described in the patents and patent applications incorporated by reference herein above, each vibration isolation mount 26, 32 may include an elastomeric portion that absorbs vibrations produced by the drive unit 16, such as those produced by an engine in the powerhead 40. In fact, it is generally known that outboard motors are subject to various vibrations including torsional or oscillational vibrations resulting from the periodic power impulses of their engines. In connection with the use of reciprocating piston engines, the outboard motor 10 is also subject to shaking forces resulting from piston movement. Additionally, movement of the drive unit's lower unit 42 and propeller through the water creates hydrodynamic loads that the vibration isolation mounts 26, 32 must also absorb. The location of the vibration isolation mounts 26, 32 therefore defines an elastic motion axis 36 of the outboard motor 10, around which the outboard motor 10 may rotate in response to the engine-caused or water-caused vibrations and/or loads. Generally, the amount and type of the elastomer used in the mounts 26, 32 are designed to provide a low spring rate that takes up vibrations that occur at a low rate. Thus, the elastomer is designed to remain soft through a particular range of motion, to damp that motion and vibration. However, vibrations or loads that cause more significant movement of the outboard motor 10 cause the elastomer to transition to a higher spring rate and provide a hard stop, thereby limiting motion of the outboard. Tight packaging of the elastomer within the mounts leaves little room for the elastomer to transition from its soft spring rate to its hard spring rate.

The drive unit 16 includes the driveshaft housing 38, which is coupled to the cradle 22 by way of the first and second upper vibration isolation mounts 26 and the first and second lower vibration isolation mounts 32. The drive unit 16 further includes the powerhead 40, which is supported by the driveshaft housing 38. In one example, the powerhead 40 is directly supported by the driveshaft housing 38. In another example, the powerhead 40 is separated from the driveshaft housing 38 by an adapter plate. In the latter instance, instead of being connected directly to the driveshaft housing 38 by way of the mounts 26, the arms 24, 25 of the cradle 22 could instead be connected to the adapter plate by way of the mounts 26. In yet another example, the swivel bracket 18 is coupled to the drive unit 16 by way of an extension bracket rather than a cradle 22 (both of which are examples of a mounting bracket). The extension bracket may be directly connected to the mounts 26, which thereafter may be connected to the adapter plate or driveshaft housing 38. The drive unit 16 further includes the lower unit 42, which depends from the driveshaft housing 38. As known to those having ordinary skill in the art, the lower unit 42 contains gears that transfer torque from a driveshaft of the engine in the powerhead 40 to a propeller shaft and propeller in order to provide propulsive force to the marine vessel.

As mentioned above, the present inventors have discovered through research and development that the amount of elastomer required in a vibration isolation mount, such as shown at 26 or 32, that would be required in order to absorb fore and aft loads imposed on the outboard motor 10 becomes problematic when tight packaging of the mounts is required in order to fit inside a particular envelope between the drive unit 16 and the transom mounting system, specifically at the above-mentioned connection points near fasteners 28, 34. The amount of elastomer used in a mount 26, 32 in order to handle the vibration characteristics of large, high horsepower engines may already max out such packaging requirements and may leave no room for the elastomer to transition to its higher spring rate. If the mounts are instead designed with elastomer of higher durometer in order to limit motion, this then compromises NVH characteristics. On the other hand, if the mounts are designed with low durometer elastomer for optimizing NVH, the outboards might then be able to move so much under high loads that they hit the transom. Greater numbers of larger, heavier outboards hitting the transom (and/or one another) causes damage to both the outboards and the boat. As engines become larger and their horsepower increases, while the envelope between the drive unit 16 and the transom 14 simultaneously decreases, this problem only gets worse.

To solve this problem, the present inventors have developed a bump stop that is located between the swivel bracket 18 and the drive unit 16, which limits deflection of the drive unit 16 caused by high loads. The bump stop obviates the need for the vibration isolation mounts to be designed to absorb such high loads, meaning the packaging of the vibration isolation mounts 26, 32 can remain compact. Specifically, the present inventors have realized that if the plurality of vibration isolation mounts 26, 32 connecting the drive unit 16 to the mounting bracket/cradle 22 is configured to absorb loads on the drive unit 16 that do not exceed a mount design threshold, the bump stop can be configured to limit deflection of the drive unit 16 caused by loads that exceed the threshold. Thus, the vibration isolation mounts 26, 32 can be designed with merely enough elastomer required to absorb loads that do not exceed the threshold. The bump stop, intended to take up loads higher than the threshold, can be located remote from the plurality of vibration isolation mounts so it does not affect efficient packaging of the vibration isolation system.

By way of illustration, FIG. 1 shows reverse loads (see arrow R) that may be imposed on the lower unit 42 of the outboard motor 10. For example, if the fore portion of the lower unit 42 were to strike a log, rock, or other underground obstacle, the drive unit 16 would rotate in the direction of the arrow labeled E around its elastic motion axis 36. Similarly, when the outboard motor 10 produces a high reverse thrust, an equal and opposite load imposed by the water through which the lower unit 42 is traveling will be imposed on the lower unit 42 and will also cause rotation about the elastic motion axis 36 as shown by arrow E. The upper portions of the drive unit 16, namely the powerhead 40 and the upper portions of the driveshaft housing 38, may potentially contact the transom mounting system 11 components (e.g., swivel bracket 18, transom bracket 12, etc.) as they rotate about the elastic motion axis 36. The present inventors have realized that by locating a bump stop at a packaging problem area, for example proximate a minimum clearance between the transom mounting system 11 and the drive unit 16 (see the area circled at 45) direct contact between the drive unit 16 and the transom mounting system 11 can be prevented, which direct contact would otherwise occur due to deflection of the drive unit 16 caused by reverse loads R that exceed the threshold.

The value of the mount design threshold itself will vary from one outboard to another and from one mounting system to another. For example, the outboard can be installed on a transom with a typical vibration isolation mount system having mounts with as much elastomer as will fit inside the tight envelope between the mounting bracket's components (e.g., cradle arms 24, 25) and the driveshaft housing 38. Whatever amount of load this mounting arrangement is capable of absorbing will define the mount design threshold. In other instances, the outboard manufacturer may specify the amount, shape, and elasticity of the vibration isolation mounts specifically to take up a particular load, based on known or tested characteristics of such mount specifications. Loads above this particular design load will therefore be those that exceed the design threshold, and will be transferred to the bump stop(s) once the vibration isolation mounts' load absorption capabilities have been maxed out. In this way, an outboard manufacturer is able to design the vibration isolation mounts with an appropriate durometer of elastomer for optimizing NVH and to be as compact as needed and/or desired, while at the same time providing motion-limiting functions of the mounting system. As mentioned above, this becomes especially important when a number of outboard motors are provided on one transom, when motion of the outboards needs to be limited to prevent damage to the outboards and/or transom without sacrificing NVH characteristics of any of the outboards.

Turning to FIGS. 2-8, it can be seen that various examples of the bump stops, labeled 244, 344, 444, 544, 644, 744, and 844 respectively, can be mounted to either a part of the drive unit 16 or a part of the transom mounting system 11, and as shown more specifically herein, to part of the swivel bracket 18 or the driveshaft housing 38. Mounting the bump stop to either one of the transom mounting system 11 and the drive unit 16 will accomplish the purpose of preventing contact between the two when loads (for example reverse loads such as those described herein above) of greater than a certain threshold are encountered. In other embodiments, bump stops can be mounted on both the fore side of the drive unit 16 and on the aft side of the mounting system 11. Bump stops can also be placed in more than one location where tolerances between the drive unit 16 and the mounting system 11 are tight. In the specific example of the outboard motor 10 shown here, the tightest tolerance is located between an aft side of the swivel bracket 18 and an upper fore side of the driveshaft housing 38, although tight tolerances might be located elsewhere on a different outboard setup.

Figure 2:
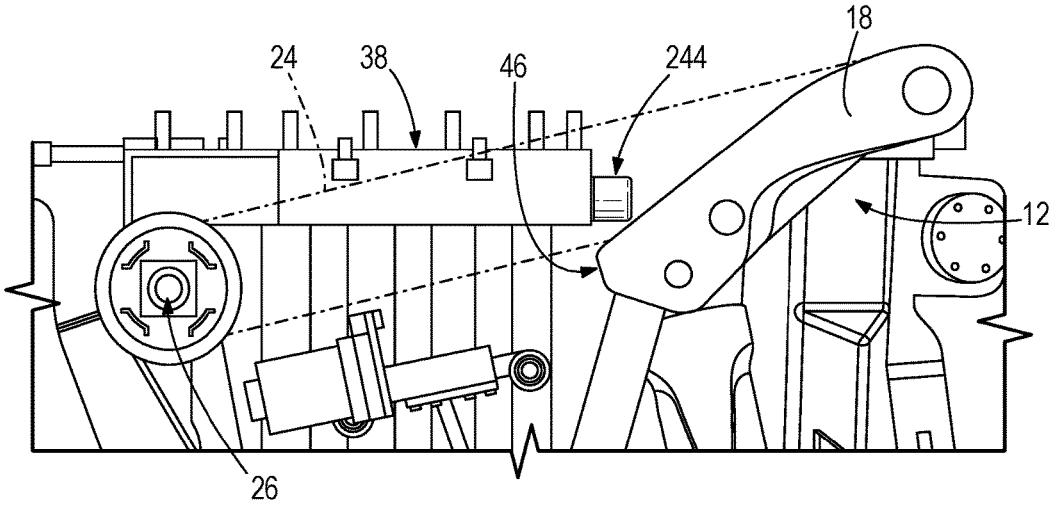
FIG. 2 illustrates a detailed side view of a portion of the outboard motor of FIG. 1, and shows one example of a bump stop according to the present disclosure.

Turning to FIG. 2, it can be seen that the bump stop 244 pictured therein is located between a fore portion of the driveshaft housing 38 and an aft portion 46 of the swivel bracket 18. More specifically, here, the bump stop 244 comprises a frustoconically-shaped elastomeric member that is mounted to the driveshaft housing 38, such as by a fastener or by being adhered thereto. The bump stop 244 shown here could be a single bump stop placed relatively in line with a center plane dividing the driveshaft housing 38 into roughly equal lateral halves. Alternatively, two (or more) spaced apart bump stops 244 could be provided along the fore side of the driveshaft housing 38.

Figure 3:
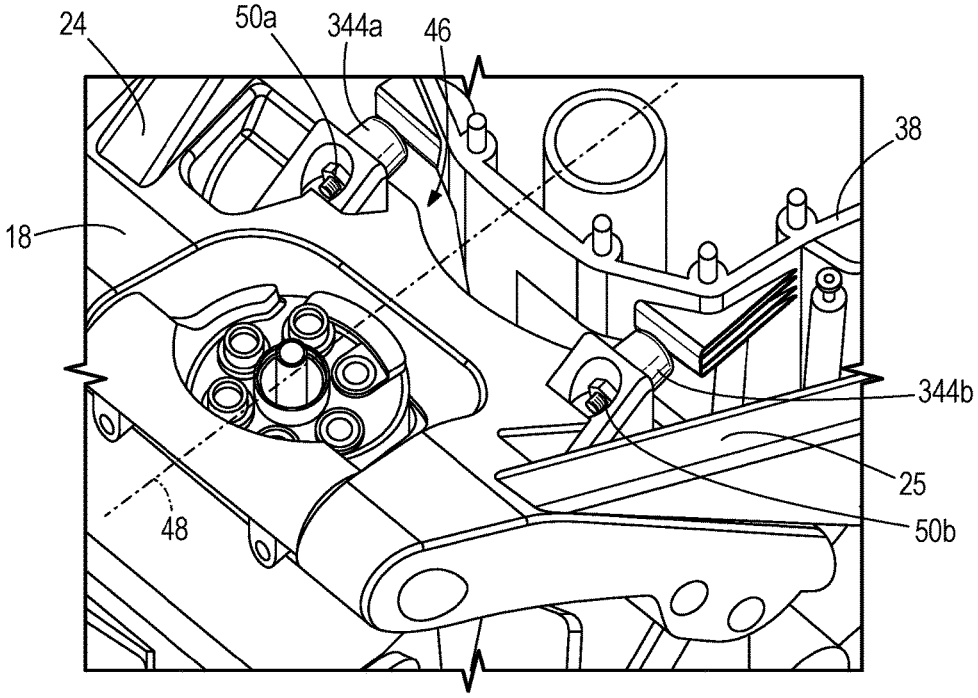
FIG. 3 illustrates a top sectional view of a portion of the outboard motor according to the present disclosure and another example of a bump stop.

A similar example is shown in FIG. 3, where two bump stops 344*a*, 344*b* are located proximate the aft portion 46 of the swivel bracket 18. More specifically, one bump stop 344*a* is located on a first side of a vertical plane 48 dividing the transom mounting system 11 into two, roughly equal lateral halves, and the other bump stop 344*b* is located on a second, opposite side of the plane 48. These at least two bump stops 344*a*, 344*b* also comprise frustoconically-shaped elastomeric members. The bump stops 344*a*, 344*b* are attached to the swivel bracket 18 by way of two attachment nubs 50*a*, 50*b* that extend from fore sides of the bump stops 344*a*, 344*b* and through holes located in the swivel bracket 18 that are specifically designed for insertion of the nubs 50*a*, 50*b* therein. Alternatively, separate fasteners could be screwed through the holes in the swivel bracket 18 and into the bump stops 344*a*, 344*b*, or the bump stops 344*a*, 344*b* could be adhered to the swivel bracket 18.

Figure 4:
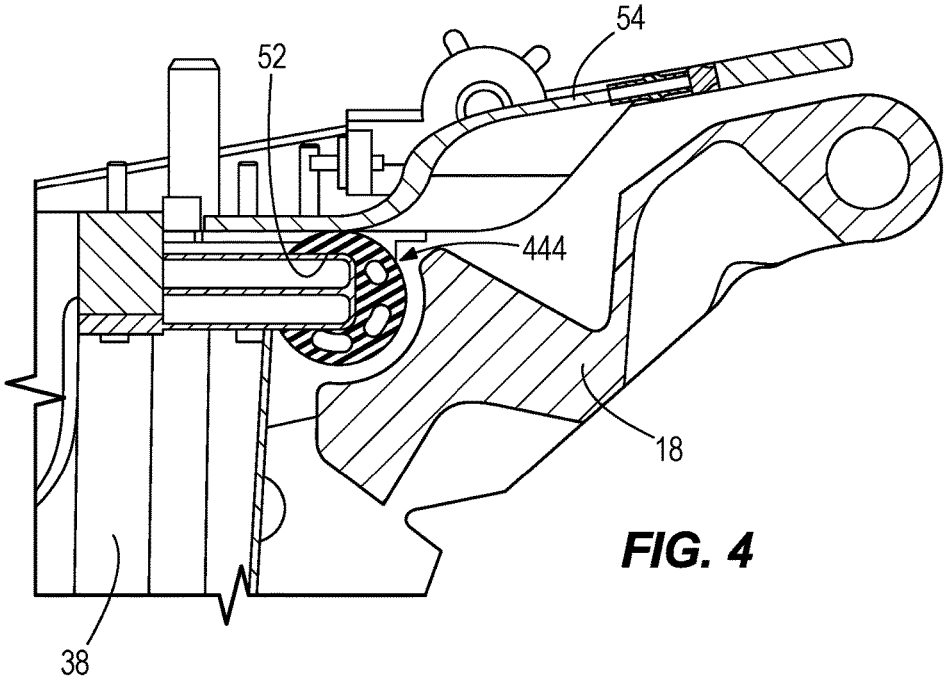
FIG. 4 illustrates a detailed view of the same area of the outboard motor as does FIG. 2 and an alternative example of a bump stop.

Turning to now FIG. 4, the bump stop 444 shown therein comprises an extruded elastomeric member that fits around a flange on the drive unit 16. For example, the extruded elastomeric member that makes up the bump stop 444 can be specifically designed and shaped to fit over an existing part of the driveshaft housing 38, such as a flange 52 provided on the upper fore side of the driveshaft housing 38 as shown herein. For example, the flange 52 may be that on top of which an adapter plate or powerhead of the drive unit 16 is supported, such as shown by the structure at 54. The bump stop 444 can be one piece that fits along and around the front face of the flange 52, or can be two or more pieces at locations where tolerances between the flange 52 and the swivel bracket 18 are tightest.

Figure 5:
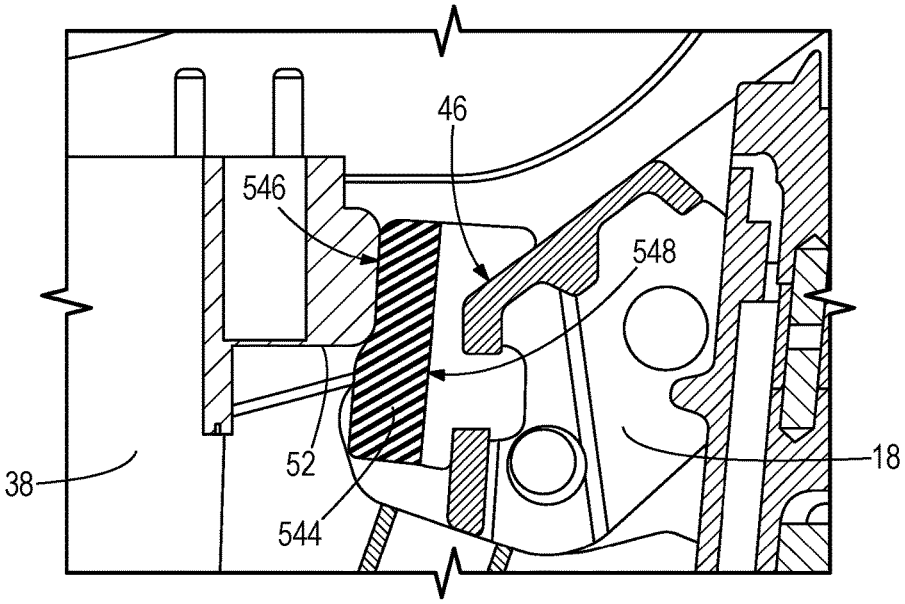
FIG. 5 illustrates another view of the same area and yet another example of a bump stop according to the present disclosure.

FIG. 5 shows a single bump stop 544 mounted on a fore side of the driveshaft housing 38 toward the center of the mounting system (i.e., straddling the vertical plane 48, FIG. 3, extending through the mounting system). The single bump stop 544 may be an elastomeric pad having a rectangular shape, as shown herein. Other shapes and/or materials could be used and still fall within the scope of the present disclosure. As shown here, the bump stop 544 is located cm the flange 52 of the driveshaft housing 38, but it could be located elsewhere if tolerances dictated another location. One side 546 of the bump stop 544 is attached to the driveshaft housing 38, such as by way of a threaded fastener or by adhering it thereto. Thus, the bump stop 544 in this example moves with the driveshaft housing 38 as it rotates about its elastic motion axis 36 when confronted by reverse loads. The opposite side 548 of the bump stop 544 is non-mounted and contacts the aft portion 46 of the swivel bracket 18 when such reverse loads are higher than the mount design threshold that the vibration isolation mounts are able to take up. Such contact limits motion of the driveshaft housing 38 in the fore-aft direction.

Figure 6:
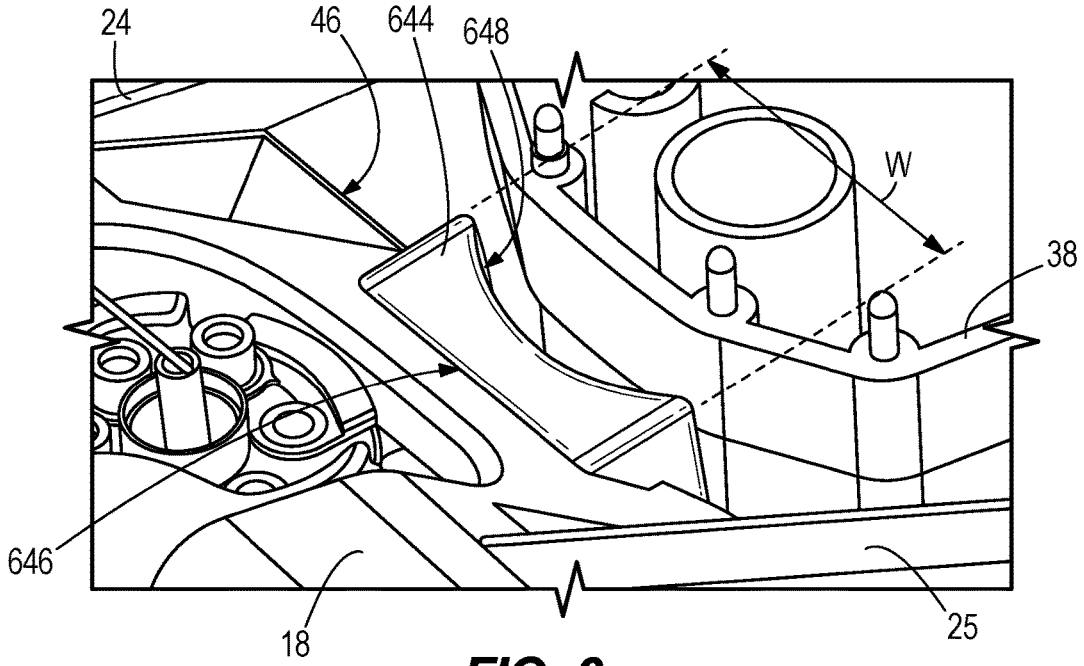
FIG. 6 illustrates the top sectional view of the outboard motor and another example of a bump stop.

Another example of an elastomeric pad that is centrally located is shown in FIG. 6. The bump stop 644 in FIG. 6 is shown as being attached to the aft portion 46 of the swivel bracket 18, as opposed to the fore portion of the driveshaft housing 38, as in FIG. 5. For example, one side 646 of the bump stop 644 is attached to the swivel bracket 18, while the opposite side 648 of the bump stop 644 is non-mounted. Thus, the bump stop 644 does not move with the driveshaft housing 38 as it rotates about its elastic motion axis 36. Rather, when loads greater than the mount design threshold are encountered, the driveshaft housing 38 moves toward the swivel bracket 18, where its motion is limited due to contact with the non-mounted face 648 of the bump stop 644. The mounted face 646 of the bump stop 644 may be flat in order to match the shape of the swivel bracket 18, while the non-mounted face 648 of the bump stop 644 may be concave in order to match the shape of the fore portion of the driveshaft housing 38.

In either example of FIG. 5 or 6, one side of the bump stop 544, 644 is mounted to either the drive unit 16 or the swivel bracket 18. The opposite, non-mounted side 548, 648 of the bump stop 544, 644 has a width, for example, width w in FIG. 6. (It should be noted that the width direction is into the page in FIG. 5.) The bump stop 544, 644 is designed such that the entire width w of the bump stop 544, 644 contacts the component to which it is not mounted while limiting deflection of the drive unit 16 caused by loads that exceed the threshold. In other words, the entire width of the non-mounted side 548, 648 of the bump stop 544, 644 is designed to take up force and to contact the opposing structure 38 or 18 to which it is not mounted when large loads act on the outboard motor 10.

In fact, in each of the examples of FIG. 2-7, it can be seen that the entire width of the bump stops shown therein contact the opposing structure to which they are not mounted. Thus, instead of force being transferred from the moving drive unit 16 to the swivel bracket 18 and through the rest of the mounting system 11 to the boat, the bump stop absorbs such loads across its full width. In other examples, the bump stop has a non-mounted face that does not contact the opposing structure along its entire width, although such examples are not shown herein. For example, the bump stop might have a non-mounted face with projections, ridges, undulations, or irregularities that contact the opposing structure, and which may even compress slightly to absorb fore-aft loads.

Figure 7:
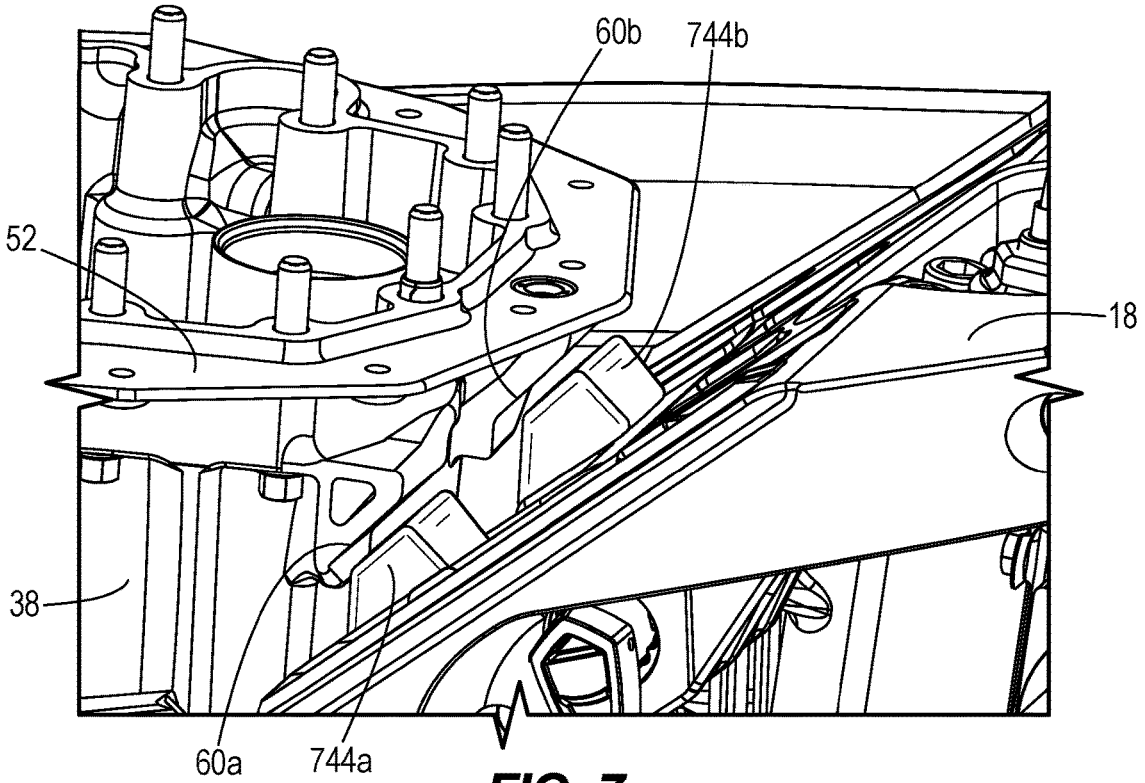
FIG. 7 is a perspective view of a portion of the outboard motor, showing another example of a pair of bump stops according to the present disclosure.

FIG. 7 shows an example in which the driveshaft housing 38 has been modified specifically to provide an area of tightest clearance between it and the swivel bracket 18, in order to make sure that any contact between the two components 38 and 18 occurs at the location of the bump stops 744*a*, 744*b*, which are mounted to the swivel bracket 18. For example, the driveshaft housing 38 is provided with co-molded or cast ramp-shaped protrusions 60*a*, 60*b* beneath its flange 52. The angle, shape, and size of the ramped bump stops 744*a*, 744*b* is such that their non-mounted faces match the angle, shape, and size of the ramped protrusions 60*a*, 60*b*. Thus, as the driveshaft housing 38 rotates about its elastic motion axis 36 under loads that exceed those the vibration isolation mounts are designed to withstand, the facing surfaces of each component contact one another, which contact limits motion of the driveshaft housing 38. It should be noted that the angle, shape, and size of the ramped bump stops 744*a*, 744*b* shown herein is not limiting on the scope of the present disclosure; rather, these components can be designed to fit an existing outboard's geometry and size. Additionally, many shapes other than those shown herein in FIGS. 2-7 can be used for the bump stops depending on the outboard and transom mounting structure geometry.

Figure 8:
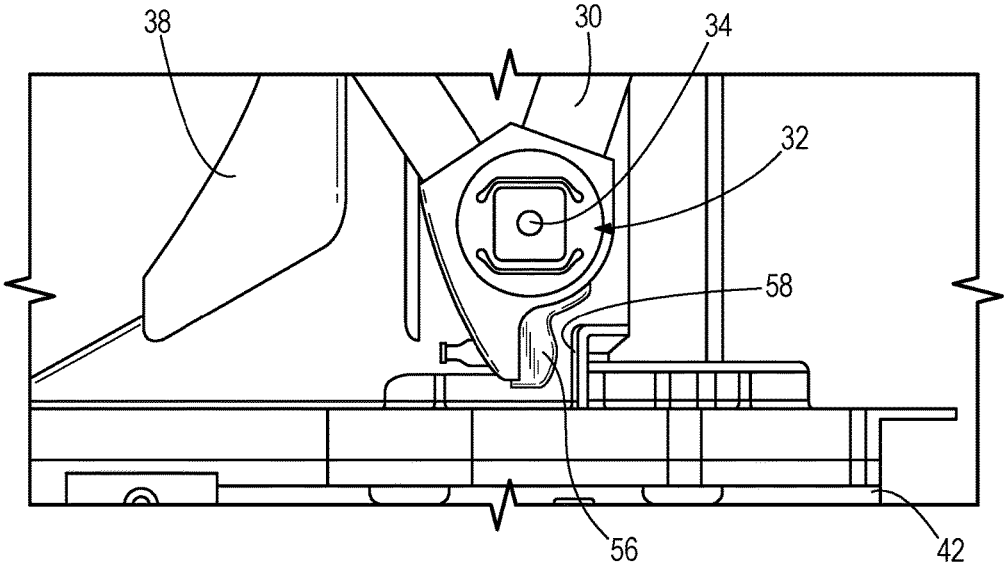
FIG. 8 illustrates a detailed view of a lower portion of an outboard motor, and shows an example of a lower bump stop according to the present disclosure.

Each of FIGS. 2-7 shows the bump stop(s) therein as being located proximate an aft portion 46 of the swivel bracket 18. However, a lower bump stop 56 may also be provided, such as shown in FIG. 8. FIG. 8 shows a close up of the lower mount 32 connected via fastener 34 to both the arm extension 30 and the lower end of the driveshaft housing 38 right above where it meets the lower unit 42. Thus, the lower bump stop 56 is located between a lower end of the mounting bracket/cradle 22 and the drive unit 16. The lower bump stop 56 is proximate to, but not a part of, one of the plurality of vibration isolation mounts, i.e., vibration isolation mount 32. Another lower bump stop can be provided on the opposite side of the driveshaft housing 38 where the opposite cradle arm extension 30 meets the opposite vibration isolation mount 32. Again, this provides decoupling of the vibration isolation mounts 32 from the first and second lower motion-limiting bump stops 56, so that the mounts 32 can be designed to take up loads of less than or equal to the mount design threshold. When loads that exceed this threshold are encountered, the lower unit 42 will rotate about the elastic motion axis 36. A protruding portion 58 of the driveshaft housing 38 will then contact the lower bump stop 56 instead of directly contacting the arm extension 30. The lower bump stops 56 therefore provide a motion-limiting function that is decoupled from the vibration isolation function of the mounts 32.

It is worth noting that the bump stop(s) in any of the above examples need not be provided on the swivel bracket 18 at a location where the bump stop would contact the driveshaft housing 38. Nor does the bump stop need to be located on the driveshaft housing 38. Rather, the bump stop(s) can be located on the swivel bracket 18 across from (or on) any structure of the drive unit 16 that is considered a superstructure of the outboard motor 10, proximate (and in some cases as near as possible to) the area where there is the tightest clearance or another packaging problem between that superstructure and the transom mounting system 11. For example, the bump stops could be configured to mount to or contact the driveshaft housing 38, adapter plate, lower unit 42, powerhead 40, and/or engine cylinder block. Each of these types of superstructures (e.g., driveshaft housing 38, adapter plate, lower unit 42, powerhead 40, and engine cylinder block) is strong enough that it would be able to withstand the forces caused by movement of the outboard motor 10 under high loads. They also provide durable surfaces to which the bump stop may be attached and/or may contact when attached to a part proximate the superstructure. Additionally, as noted above, if the aft side 46 of the swivel bracket 18 is not where tightest clearance is located, the bump stop could instead be provided on an aft side of a different component of the mounting system 11, such as on the transom bracket 12, the mounting bracket 22, a steering column, etc.

Additionally, the bump stop need not be an elastomeric member. For example, the bump stop could be a molded piece of plastic or other type of material that is relatively more elastic than the material of which the driveshaft housing 38 and mounting system 11 are made. In the event that the bump stop is an elastomer, either thermoplastic polyurethane (TPU) or natural rubber would be suitable. In fact, any moldable elastomer having a durometer that is generally greater than that used for the vibration isolation mounts would be suitable for the purposes described herein. That the durometer of the elastomer of the bump stop is greater than the durometer of the elastomer in the vibration isolation mounts provides a higher spring rate needed for motion-limiting purposes.

In other examples, the bump stop could be a hydraulic bump stop, such as those used on cars and trucks. The hydraulic bump stop would comprise a piston-cylinder type of mechanism that would allow movement through a first range of motion, but would damp movement through a second range. Either the piston or cylinder could be attached to the superstructure of the drive unit 16, and the other of the piston and cylinder could be attached to the swivel bracket 18.

Additionally, although the bump stops shown and described herein are pictured as being in front of the elastic motion axis 36 of the outboard motor 10, this need not necessarily be so. Rather, placement of the bump stops depends on the packaging and clearance between the drive unit 16 and the transom mounting system 11, such as between the mounting bracket/cradle 22 and the swivel bracket 18 and/or tilt tube (see tilt/trim axis 20). Additionally, bump stops could be provided on the inside back of the cradle 22 or on the back of the lower mount 32, so as to take up forces in a forward direction that exceed those the vibration isolation mounting system is designed to handle. For example, referring to FIG. 8, a bump stop could be provided on the outer aft side of each lower mount 32, which would contact the driveshaft housing 38 in the event that the outboard encounters forward loads greater than those the mounts are able to withstand.

Thus, the NVH system and motion-limiting system of the present disclosure can be decoupled from one another by providing first and second upper vibration isolation mounts 26 that are designed together to absorb loads on the drive unit 16 that do not exceed the mount design threshold, and a motion limiting bump stop that is designed to absorb loads that exceed the threshold and that would otherwise cause contact between a superstructure of the drive unit 16 and the swivel bracket 18. This allows for easier packaging of the vibration-isolation mounting system as well as for different types of motion-limiting systems, such as elastomeric and/or hydraulic systems, to be used to limit motion of the outboard motor 10 that cannot otherwise easily be limited by the vibration isolation mounting system. The two systems can therefore be tuned or designed to have different spring rates ideal for their specific purpose.

In the above description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein may be used alone or in combination with other systems and methods. It is to be expected that various equivalents, alternatives and modifications are possible within the scope of the appended claims.

What is claimed is:

1. A marine propulsion support system comprising:

a transom mounting system including:

a transom bracket configured to be mounted to a transom of a marine vessel;

a swivel bracket coupled to the transom bracket; and a mounting bracket coupled to the swivel bracket;

a drive unit coupled to the mounting bracket;

a plurality of vibration isolation mounts connecting the drive unit to the mounting bracket, the plurality of vibration isolation mounts configured to absorb loads on the drive unit that do not exceed a mount design threshold; and a bump stop located between the swivel bracket and the drive unit, the bump stop limiting deflection of the drive unit caused by loads that exceed the mount design threshold;

wherein the bump stop is mounted to one of the transom mounting system and the drive unit and does not contact the other of the drive unit and the transom mounting system when loads that do not exceed the mount design threshold are encountered.

2. The system of claim 1, wherein the bump stop is located remote from the plurality of vibration isolation mounts.

3. The system of claim 2, wherein the bump stop is located proximate a minimum clearance between the swivel bracket and the drive unit.

4. The system of claim 3, wherein the bump stop is mounted to one of the swivel bracket and the drive unit.

5. The system of claim 4, wherein an entire width of a side of the bump stop that is not mounted to the one of the swivel bracket and the drive unit contacts the other of the drive unit and the swivel bracket when limiting deflection of the drive unit caused by loads that exceed the mount design threshold.

6. The system of claim 3, wherein the bump stop is located between a fore portion of a driveshaft housing of the drive unit and an aft portion of the swivel bracket.

7. The system of claim 6, further comprising at least two bump stops mounted to the aft portion of the swivel bracket, one of the at least two bump stops located on a first side of a vertical plane dividing the transom mounting system into two, roughly equal lateral halves, and another of the at least two bump stops located on a second, opposite side of the plane.

8. The system of claim 7, wherein the at least two bump stops comprise ramped-shaped elastomeric members.

9. The system of claim 1, wherein the bump stop comprises an elastomeric bump stop.

10. The system of claim 1, further comprising a lower bump stop located between a lower end of the mounting bracket and the drive unit, wherein the lower bump stop is proximate to, but not part of, one of the plurality of vibration isolation mounts.

11. A marine propulsion support system comprising:

a transom mounting system configured to be mounted to a transom of a marine vessel;

a drive unit coupled to the transom mounting system;

a plurality of vibration isolation mounts coupling the drive unit to the transom mounting system, the plurality of vibration isolation mounts configured to absorb loads on the drive unit that do not exceed a mount design threshold; and a bump stop located between the drive unit and the transom mounting system, the bump stop limiting deflection of the drive unit caused by loads that exceed the mount design threshold;

wherein the bump stop is located proximate a minimum fore-aft clearance between the transom mounting system and the drive unit, and prevents direct contact between the drive unit and the transom mounting system that would otherwise occur due to deflection of the drive unit caused by loads that exceed the mount design threshold;

wherein the bump stop is mounted to one of the transom mounting system and the drive unit and does not contact the other of the drive unit and the transom mounting system when loads that do not exceed the mount design threshold are encountered; and wherein the bump stop is located remote from the plurality of vibration isolation mounts.

12. The system of claim 11, wherein the transom mounting system includes:

a transom bracket configured to be mounted to the transom of the marine vessel;

a swivel bracket coupled to the transom bracket; and a mounting bracket coupled to the swivel bracket;

wherein the plurality of vibration isolation mounts connects the mounting bracket to the drive unit; and wherein the bump stop is located between the swivel bracket and the drive unit.

13. An outboard motor comprising:

a transom bracket configured to be mounted to a transom of a marine vessel;

a swivel bracket pivotally coupled to the transom bracket about a horizontal tilt-trim axis;

a cradle coupled to the swivel bracket, the cradle having first and second opposite arms;

a drive unit supported between the first and second opposite arms of the cradle;

first and second upper vibration isolation mounts, the first upper vibration isolation mount connecting the first cradle arm to the drive unit, and the second upper vibration isolation mount connecting the second cradle arm to the drive unit;

an upper motion-limiting bump stop located remotely from the first and second upper vibration isolation mounts and between the swivel bracket and the drive unit;

first and second arm extensions depending generally downwardly from the first and second cradle arms, respectively;

first and second lower vibration isolation mounts connecting the first arm extension to the drive unit and the second arm extension to the drive unit, respectively; and first and second lower motion-limiting bump stops located between the first arm extension and the drive unit and the second arm extension and the drive unit, respectively;

wherein the upper motion-limiting bump stop is located between the swivel bracket and a superstructure of the drive unit; and wherein the first and second lower motion-limiting bump stops are proximate to, but not part of, the first and second lower vibration isolation mounts.

14. The outboard motor of claim 13, wherein the drive unit includes a driveshaft housing connected to the cradle by way of the first and second upper vibration isolation mounts and the first and second lower vibration isolation mounts, a powerhead supported by the driveshaft housing, and a lower unit depending from the driveshaft housing.

15. The outboard motor of claim 14, wherein the upper motion-limiting bump stop is located proximate a minimum clearance between the swivel bracket and the driveshaft housing and prevents contact between the driveshaft housing and the swivel bracket.

16. The outboard motor of claim 13, wherein:

the first and second upper vibration isolation mounts are designed to together absorb loads on the drive unit that do not exceed a mount design threshold; and the upper motion-limiting bump stop is designed to absorb loads that exceed the mount design threshold and that would otherwise cause contact between the superstructure and the swivel bracket.

17. The outboard motor of claim 16, wherein the upper motion-limiting bump stop is mounted to one of the swivel bracket and the superstructure.

18. The outboard motor of claim 17, wherein an entire width of a side of the upper motion-limiting bump stop that is not mounted to the one of the swivel bracket and the superstructure contacts the other of the superstructure and the swivel bracket when limiting motion caused by loads that exceed the mount design threshold.

* * * * *